US007779663B1

(12) United States Patent
Chen

(10) Patent No.: US 7,779,663 B1
(45) Date of Patent: Aug. 24, 2010

(54) FINISHED PRODUCT RECEIVING RACK OF A CORRUGATED METAL SHEET MEMBER FABRICATION SYSTEM

(76) Inventor: Chun-Liang Chen, 2F., No. 20-1, Ting-Tien-Liao, Tamshui Town, Taipei Hsien (TW)

( * ) Notice: Subject to any disclaimer, the term of this patent is extended or adjusted under 35 U.S.C. 154(b) by 528 days.

(21) Appl. No.: 11/806,080

(22) Filed: May 29, 2007

(51) Int. Cl.
*B21D 13/02* (2006.01)
*B21D 45/00* (2006.01)
*B21C 47/00* (2006.01)

(52) U.S. Cl. ..... 72/385; 72/134; 72/426

(58) Field of Classification Search ..... 72/379.6, 72/385, 419, 422, 423, 426, 428, 251; 198/466.1, 198/468.6
See application file for complete search history.

(56) References Cited

U.S. PATENT DOCUMENTS 3,687,446 A * 8/1972 Neumann et al. ..... 271/176
5,359,875 A * 11/1994 Sova ..... 72/336
6,983,837 B1 * 1/2006 Chen ..... 198/466.1

* cited by examiner

*Primary Examiner*—Dana Ross
*Assistant Examiner*—Mohammad Yusuf
(74) *Attorney, Agent, or Firm*—Jackson IPG PLLC

(57) ABSTRACT

A finished product receiving rack used in a corrugated metal sheet member fabrication system for receiving finished products in which two guardrails with protective members are arranged in parallel along the length of the rack body to guide delivering finished products in course and to prevent accidental injury to workers, and steering gears and guide screws are arranged on the rack body and rotatable by motors to move the guardrails and to further adjust the gap between the guardrails subject to the size of the finished products to be carried.

4 Claims, 10 Drawing Sheets

FINISHED PRODUCT RECEIVING RACK OF A CORRUGATED METAL SHEET MEMBER FABRICATION SYSTEM

BACKGROUND AND SUMMARY OF THE INVENTION

The present invention relates to a corrugated metal sheet member fabrication system and more particularly, to a finished product receiving rack used in a corrugated metal sheet member fabrication system.

FIG. 1 shows a conventional corrugated metal sheet member fabrication system 10 for making corrugated metal sheets or metal tiles. During operation of this structure of corrugated metal sheet member fabrication system 10, metal sheet material 100 is delivered from a material feeder 101 to a roller ramming unit 102 and roller-rammed into a corrugated form by the roller ramming unit 102, and the corrugated metal sheet material is then properly cut by a cutting unit 103 into corrugated metal sheet members subject to the desired size, and the finished products are then delivered one after another to a finished product receiving rack 105 by a conveyer 104. The finished product receiving rack 105 consisting rollers 1051 has a certain length. Workers are standing at two sides of the finished product receiving rack 105 to pick up and pack finished products. This manufacturing line requires much longitudinal installation space. Further, this design of corrugated metal sheet member fabrication system requires much labor and time to pick up and pack finished products.

FIGS. 2-5 show another design of corrugated metal sheet member fabrication system 9 using a different finished product receiving rack 95. According to this design; the finished product receiving rack 95 comprises an elongated rack body 951 with rollers 952, two driving rods 97 longitudinally arranged in parallel, two sets of links 96 each having an inner end 961 respectively pivoted to the rollers 952 and an outer end 962 respectively pivoted to the driving rods 97, and two air cylinders 98 each having a piston rod 981 respectively coupled to a middle part of one link 96 of each of the two sets of links 96. When the air cylinders 98 are driven to extend out the respective piston rods 981, the links 96 are forced to bias the rollers 952 outwards from the operative position to the non-operative position (see FIG. 4) for enabling the received finished metal sheet members (not shown) to fall to a carriage 99 below for collection in stack. On the contrary, when the air cylinders 98 are driven to receive the respective piston rods 981, the links 96 are forced to bias the rollers 952 inwards from the non-operative position to the operative position for receiving finished metal sheet members from the metal sheet member processing machine. This design of finished product receiving rack is still not satisfactory in function because of the following drawbacks:

1. For receiving different metal sheet members, such as corrugated metal sheets or metal tiles having an unequal width, the finished product receiving rack has no baffle means at the let and right sides to guide the moving direction of the delivering finished metal sheet members, and the finished metal sheet members may not fall to the carriage 99 accurately, causing further finished metal sheet member collection inconvenience.

2. The gap 90 between the rollers 952 at the elongated rack body 951 and the carriage 99 is limited (see FIG. 4). Extending the gap 90 between the rollers 952 and the carriage 99 will cause the finished metal sheet members to deviate when falling to the carriage 99, and collected finished metal sheet members will not be piled up in the carriage 99 neatly to the desired height.

Therefore, it is desirable to provide a finished product receiving rack for corrugated sheet member fabrication system, which eliminates the aforesaid drawbacks.

The present invention has been accomplished under the circumstances in view. It is therefore the main object of the present invention to provide a finished product receiving rack for corrugated sheet member fabrication system, which eliminates the drawbacks of the aforesaid prior art designs. According to one aspect of the present invention, the finished product receiving rack comprises two guard rails with protective members arranged in parallel at two sides along the length of the rack body to guide delivery of finished metal sheet members in course, preventing deviation of delivering finished metal sheet members or accidental injury to the workers by delivering finished metal sheet members. Therefore, finished metal sheet members can be collected in stacks accurately for further packaging.

According to another aspect of the present invention, a plurality of transfer tables are transversely arranged below the rack body, and a plurality of lifters are spaced from one another along the length of the rack body and controllable to move vertically between the rollers at the rack body and the transfer tables for collecting finished products from the rollers in a stack and carrying stacked finished products to the transfer tables.

DETAILED DESCRIPTION OF THE INVENTION

Figure 1:
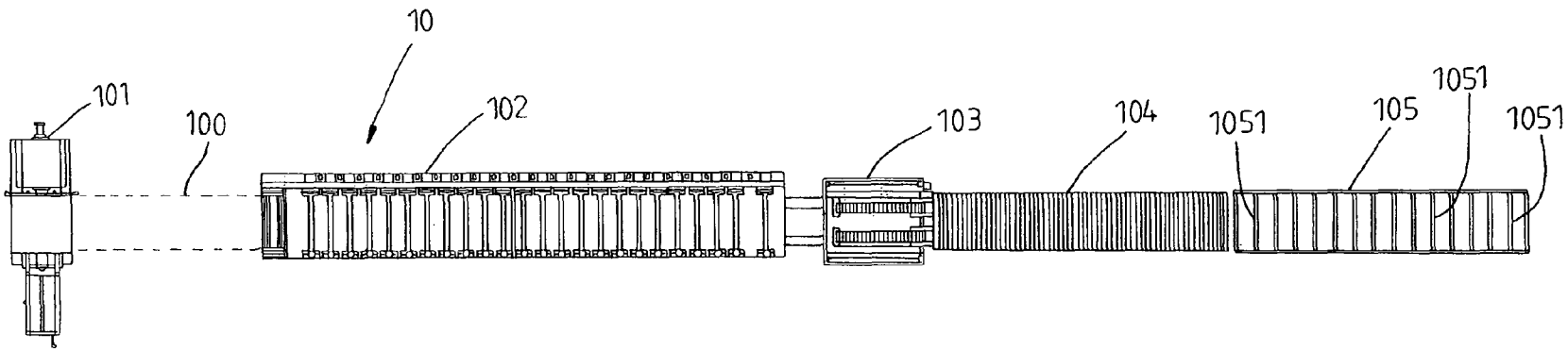
Fig. 1 PRIOR ART
FIG. 1 is a top plain view of a corrugated metal sheet member fabrication system according to the prior art.
Figure 2:
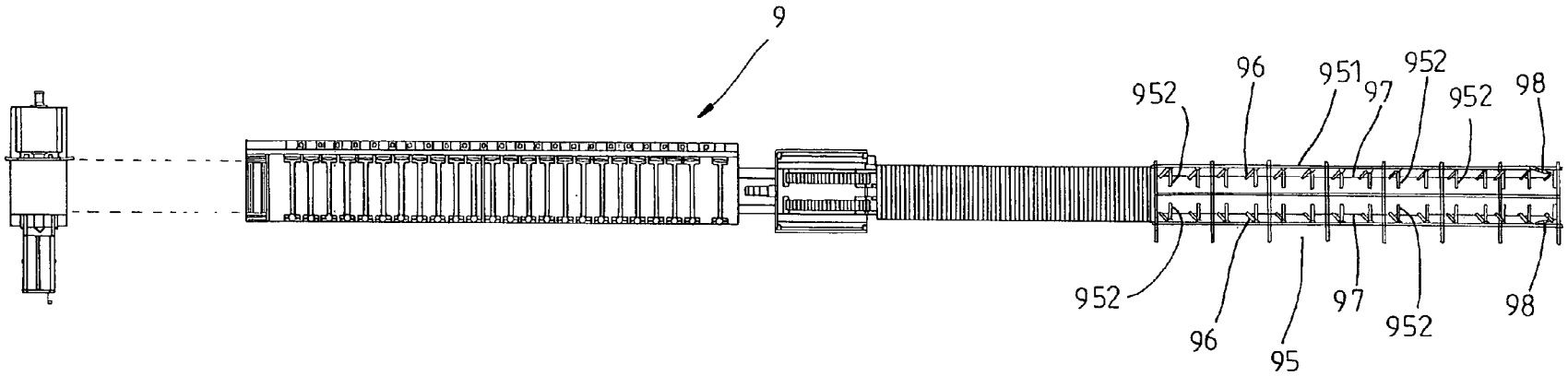
Fig. 2 PRIOR ART
FIG. 2 is a top plain view of another design of corrugated metal sheet member fabrication system according to the prior art.
Figure 3:
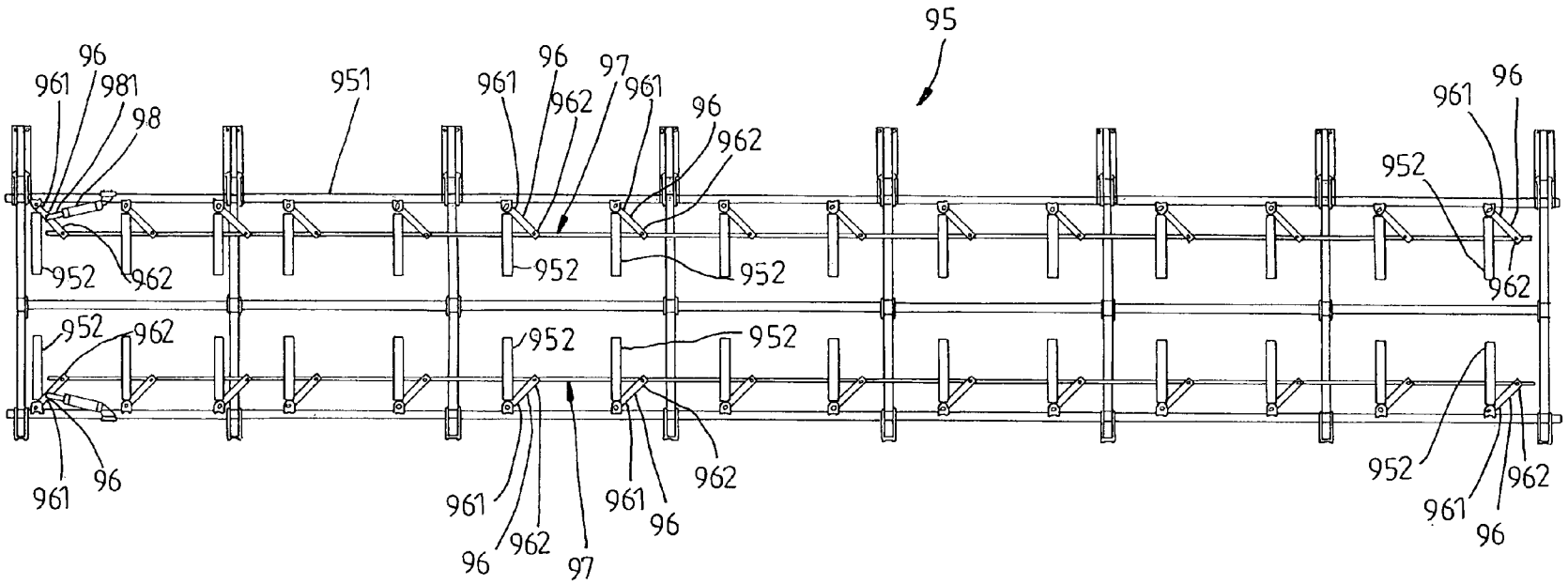
Fig. 3 PRIOR ART
FIG. 3 is an enlarged view of FIG. 2.
Figure 4:
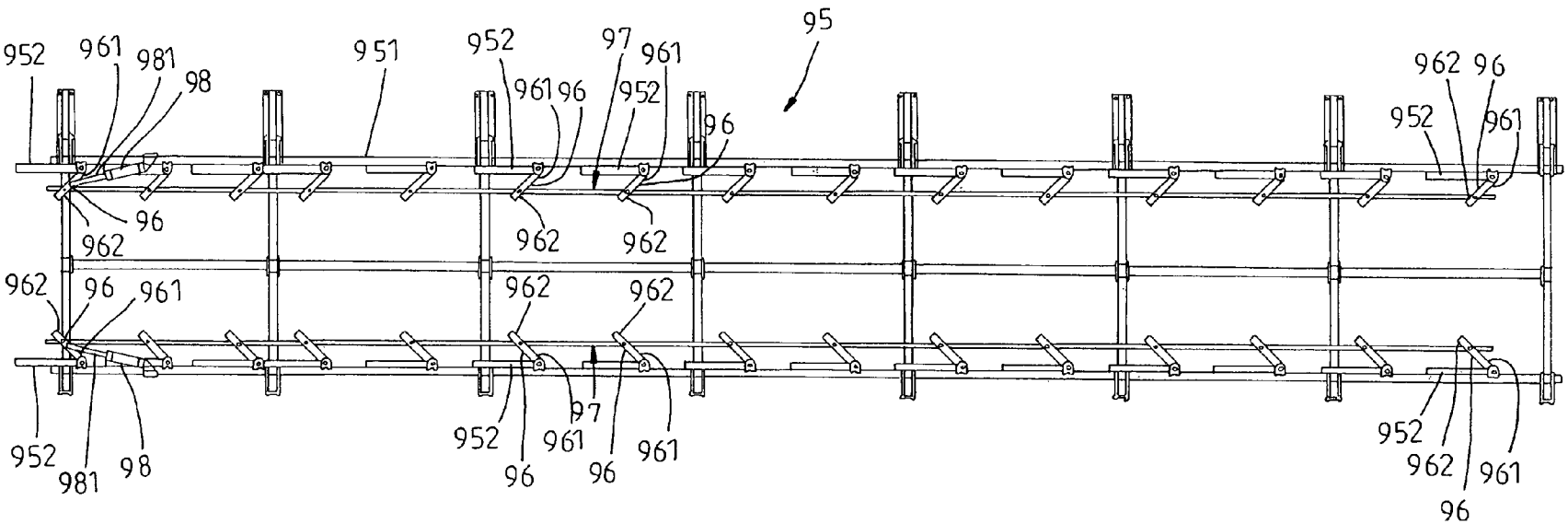
Fig. 4 PRIOR ART
FIG. 4 corresponds to FIG. 3, showing the rollers biased outwards.
Figure 5:
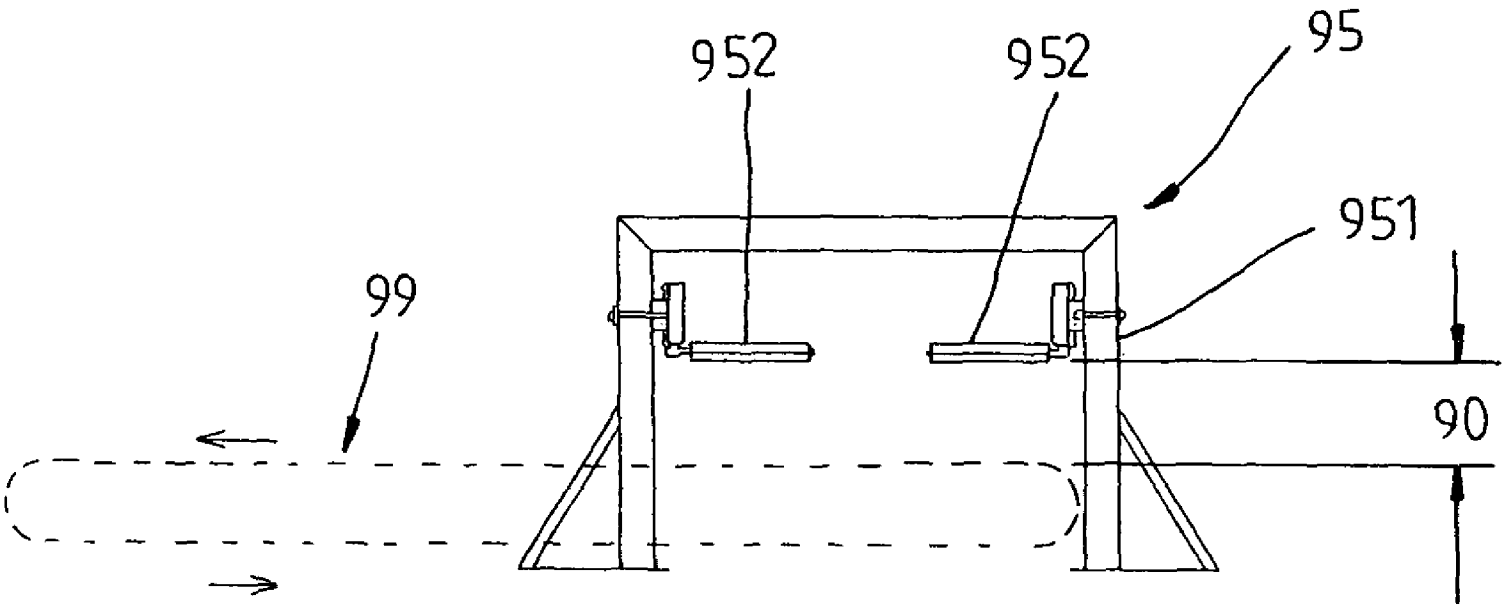
Fig. 5 PRIOR ART
FIG. 5 is a schematic rear side view of the corrugated metal sheet member fabrication system shown in FIG. 2.
Figure 6:
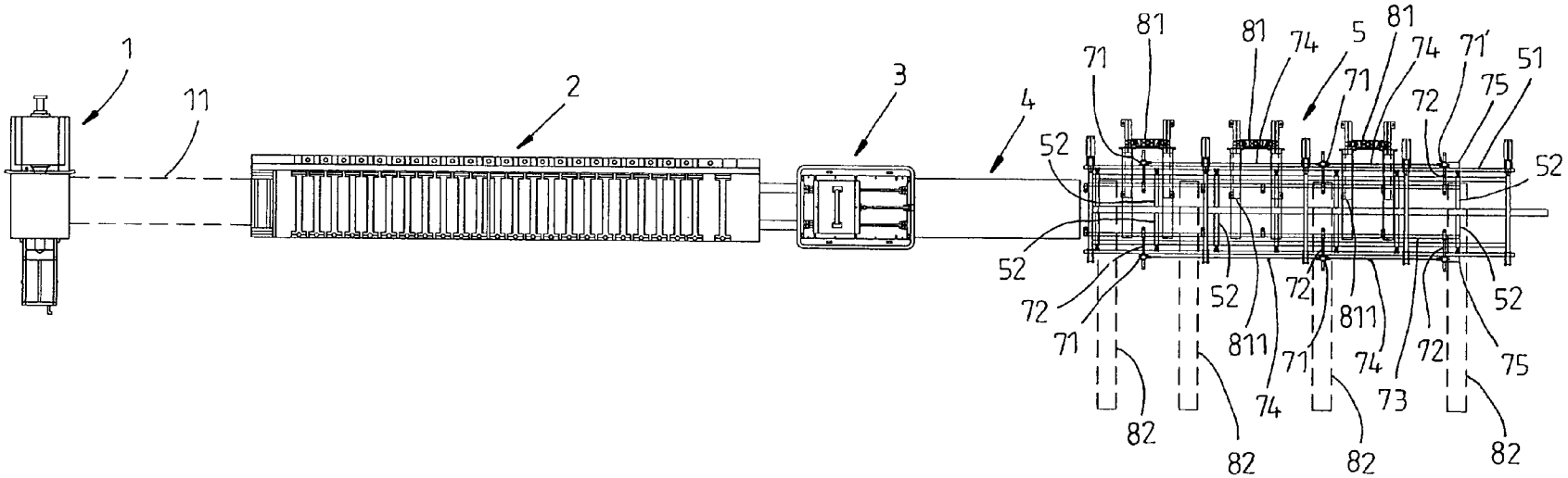
FIG. 6 is a top plain view of a corrugated metal sheet member fabrication system according to the present invention.

Referring to FIGS. 6-10, a corrugated metal sheet member fabrication system in accordance with the present invention is shown comprised of a material feeder 1, a roller ramming unit 2, a cutting unit 3, a conveyer 4, and a finished product receiving rack 5. Metal sheet material 11 is delivered from the material feeder 1 to the roller ramming unit 2 and roller-rammed into a corrugated form by the roller ramming unit 2, and then the corrugated metal sheet material 11 is properly cut by the cutting unit 3 into corrugated metal sheet members 16 subject to the desired size, and then the finished products 16 are delivered one after another to the two rows of rollers 52 at the rack body 51 of the finished product receiving rack 5 by the conveyer 4 (see FIGS. 7 and 8).

Figure 7:
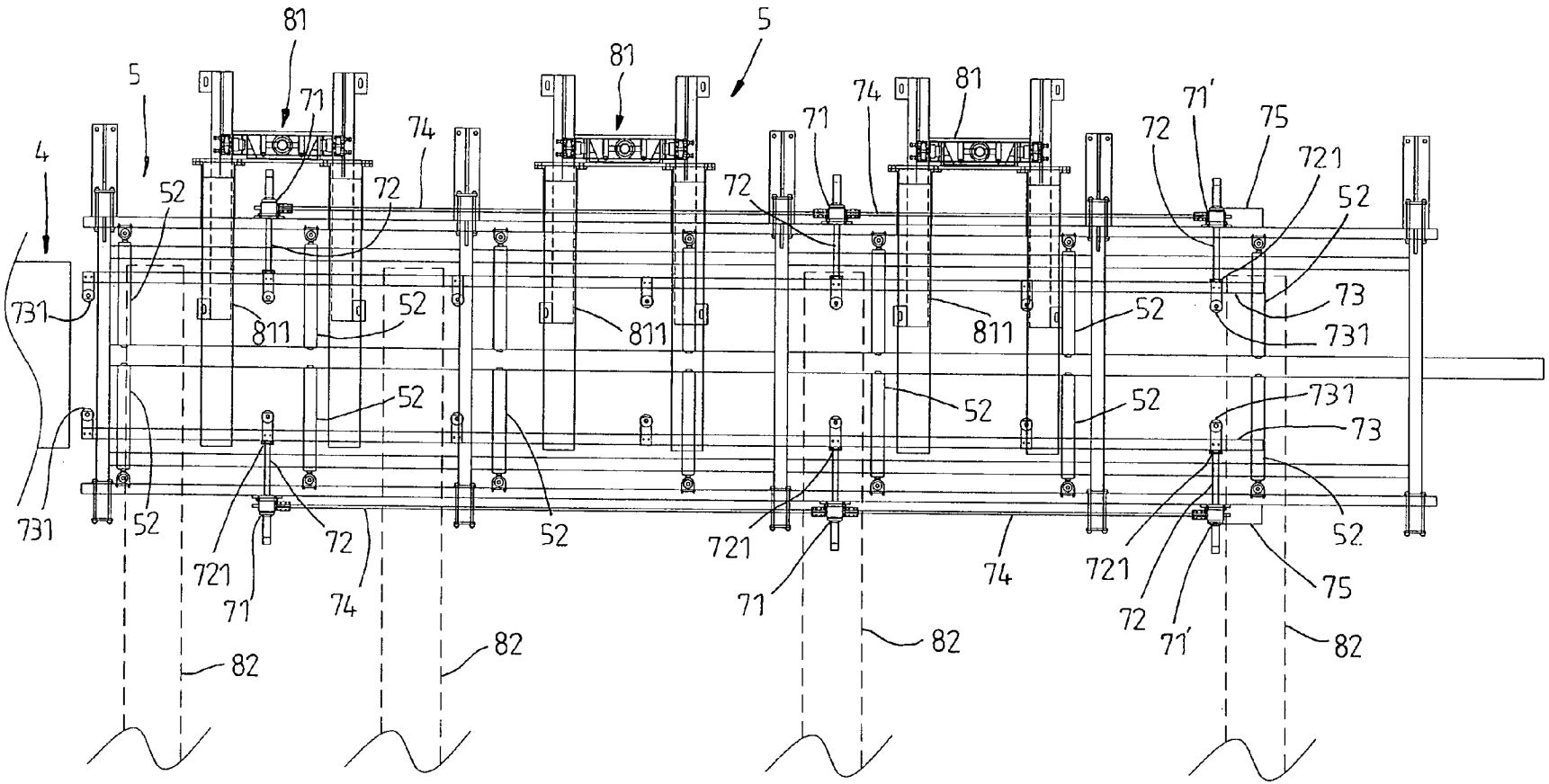
FIG. 7 is a top plain view in an enlarged scale of a part of FIG. 6, showing the structure of the finished product receiving rack.
Figure 8:
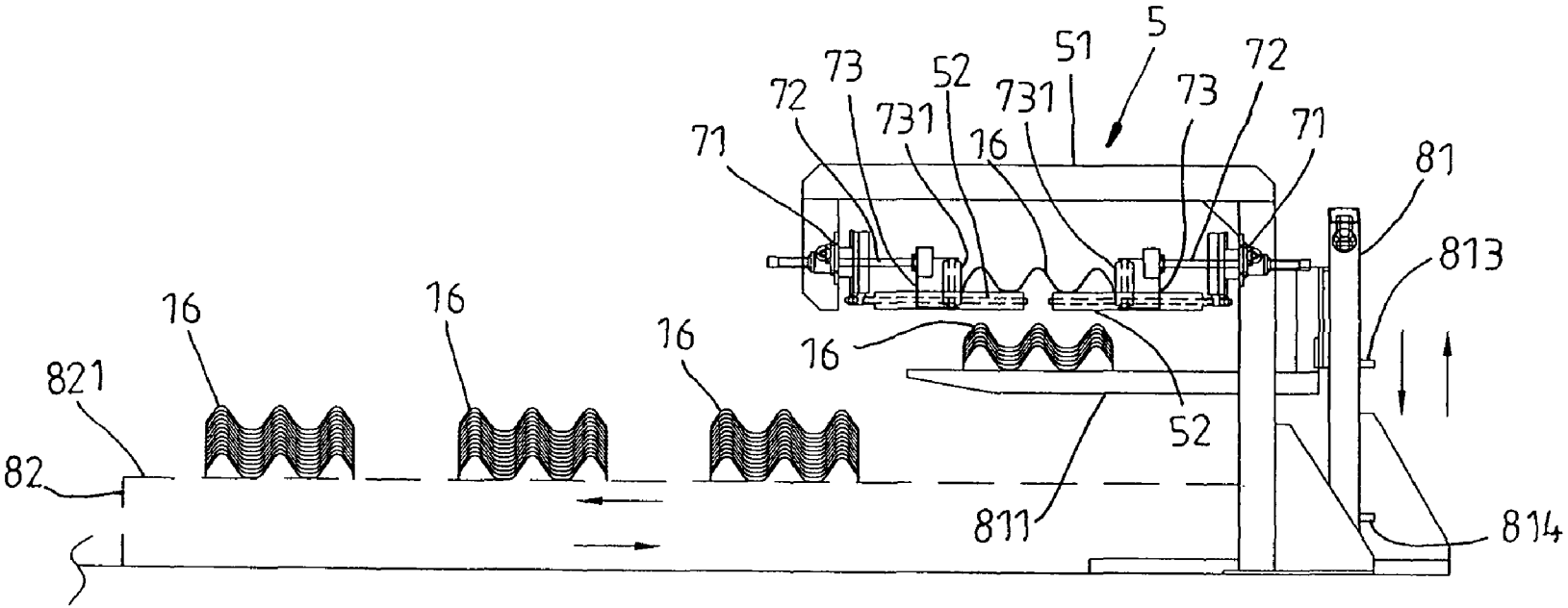
FIG. 8 is a schematic rear side view of the corrugated metal sheet member fabrication system according to the present invention.
Figure 9:
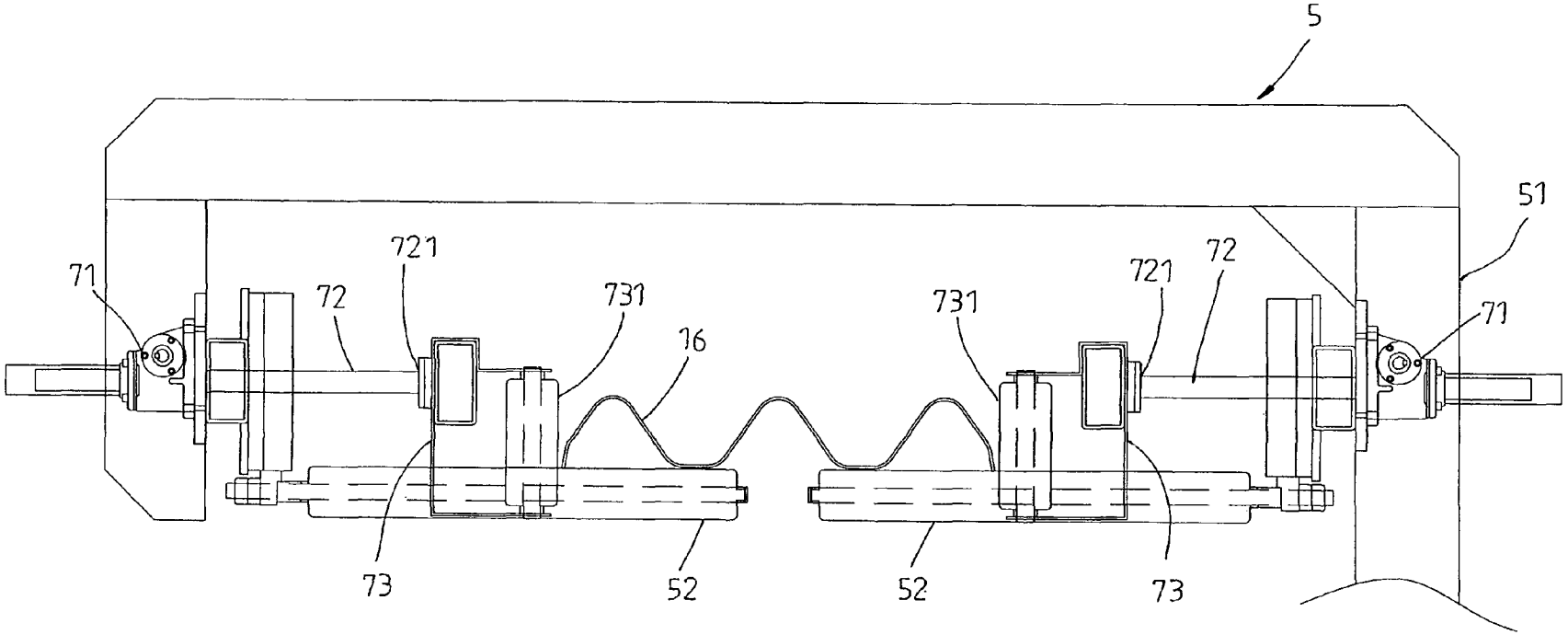
FIG. 9 is an enlarged view of a part of FIG. 8.
Figure 10:
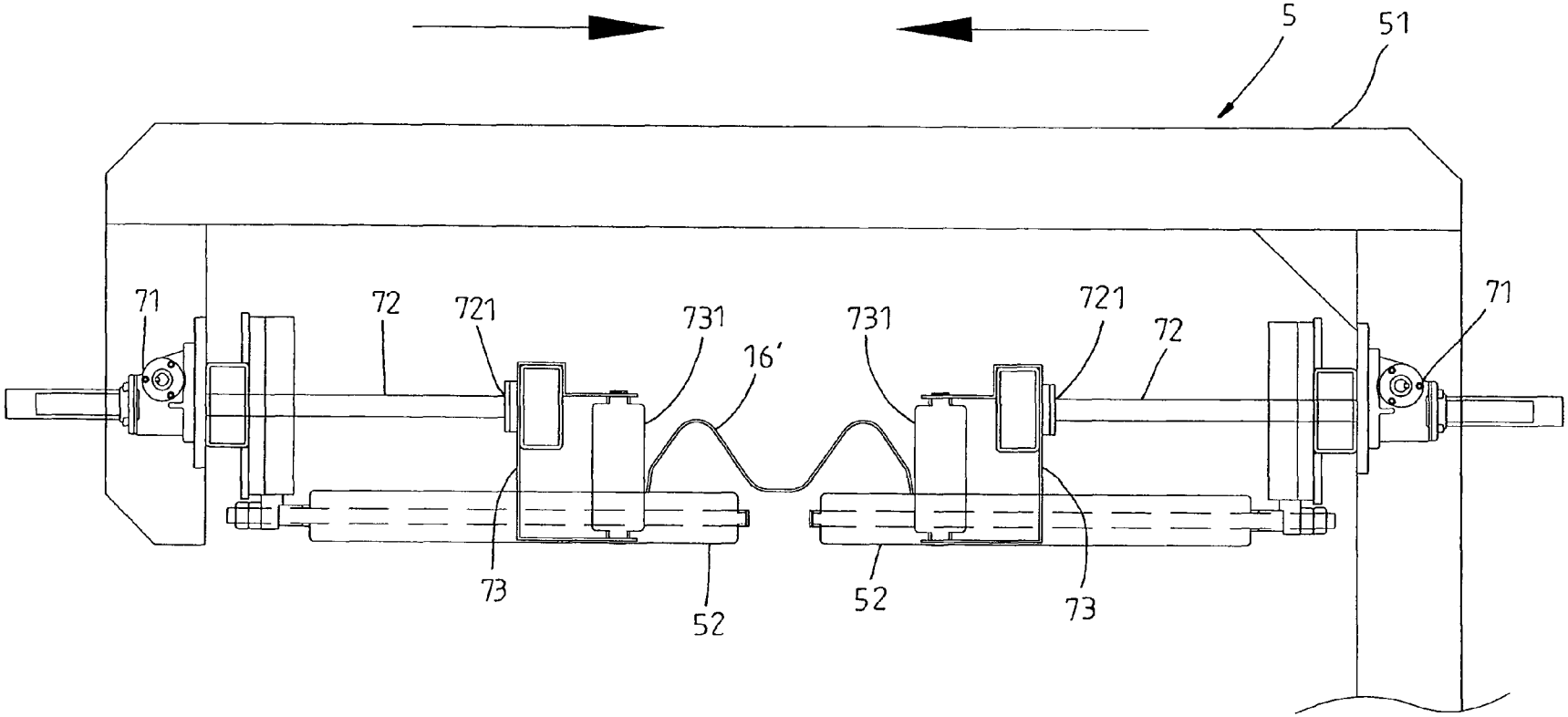
FIG. 10 corresponds to FIG. 9, showing the gap between the two guardrails adjusted.

Referring to FIGS. 6-10 again, the finished product receiving rack 5 comprises:

two guardrails 73 arranged in parallel along the length of the rack body 51;

two transmission shafts 74 arranged in parallel along the length of the rack body 51;

two sets of steering gears 71 and 71' arranged on the rack body 51 at two opposite lateral sides along the length of the rack body 51 corresponding to the rollers 52 and respectively coupled to the transmission shafts 74 (see FIG. 7);

two sets of guide screws 72 respectively coupled to the steering gears 71 and 71', the guide screw 72 having the respective outer ends 721 respectively fastened to the guardrails 73 (see FIGS. 7 and 9); and two motors 75 fixedly mounted on the rack 51 at two sides and respectively coupled to one steering gear 71 or 71' at the corresponding side.

When the motors 75 are started to rotate the associating connected steering gears 71 and 71' in one direction, the transmission shafts 74 are driven to rotate the other steering gears 71 and 71', thereby forcing the guide screws 72 to move the guardrails 73 toward each other. On the contrary, when the motors 75 are started to rotate the associating connected steering gears 71 and 71' in the reversed direction, the transmission shafts 74 are driven to reverse the other steering gears 71 and 71', thereby forcing the guide screws 72 to move the guard rails 73 apart from each other. Therefore, by means of controlling the direction of rotation of the motors 75, the gap between the two guardrails 73 is relatively adjusted. Protective members, for example, protective rollers 731 may be provided at the guardrails 73 to keep the delivering finished metal sheet members 16 in course so that the finished metal sheet members 16 can be collected in a stack in the carriage (not shown) below the rack body 51 when the finished metal sheet members 16 fall from the rack body 51 after the rollers 52 have been turned outwards to the non-operative position.

The finished product receiving rack 5 further comprises a plurality of lifters 81 spaced from one another along the length of the rack body 51, and a plurality of transfer tables 82 arranged at two sides of the lifters 81 and extending in transverse direction below the rack body 51. The lifters 81 each have a lifting platform 811 suspending below the rollers 52.

A control circuit (not shown) controls the lifters 81 to move the respective lifting platforms 811 vertically between the rollers 52 and the transfer tables 82, so as to collect finished metal sheet members 16 from the rollers 52 in stack and to carry collected stacks of finished metal sheet members 16 to the transfer tables 82.

Further, upper limit sensors 813 and lower limit sensors 814 are installed in the top and bottom sides of the lifters 81 to detect the elevation of the lifting platforms 811. When the lifting platforms 811 are lowered to a predetermined lower limit elevation, the lower limit sensors 814 (see FIG. 8) are induced to give a signal to the control circuit, causing the control circuit to stop the lifters 81 and the cutting unit 3. After a predetermined time interval, the control circuit drives the lifters 81 to lift the lifting platforms 811 toward the rollers 52. When the lifting platforms 811 are lifted to a predetermined upper limit elevation, the upper limit sensors 813 are induced to give a signal to the control circuit, causing the control circuit to stop the lifters 81, allowing the lifting platforms 811 to collect finished metal sheet members 16 from the rollers 52.

As indicated above, the design of the finished product receiving rack of the corrugated metal sheet member fabrication system has the following features and advantages:

1. The guard rails 73 with protective members are arranged in parallel at sides along the length of the rack body 51 to guide delivery of finished metal sheet members 16 in course, preventing deviation of delivering finished metal sheet members 16 or accidental injury to the workers by delivering finished metal sheet members 16. Therefore, finished metal sheet members 16 can be collected in stacks accurately for further packaging when they fall from the rack body 51 after the rollers 52 have been turned to the non-operative position.

2. The lifters 81 are controllable to move the respective lifting platforms 811 upwards and downwards between the rollers 52 and the transfer tables 82 to collect finished metal sheet members 16 in stack and to carry stacked finished metal sheet members 16 to the transfer tables 82 for further packaging.

3. The gap between the two guardrails 73 at the rack body 51 is adjustable by means of controlling the operation and direction of rotation of the motors 72, fitting different sizes of finished metal sheet members 16 or 16'.

While only one embodiment of the present invention has been shown and described, it will be understood that various modifications and changes could be made thereunto without departing from the spirit and scope of the invention disclosed.

What is claimed is:

1. A finished product receiving rack of the type used in a corrugated metal sheet member fabrication system and having two rows of rollers pivotally mounted on a rack body thereof and movable between an operative position for carrying finished products from the corrugated metal sheet member fabrication system and a non-operative position for letting carried finished products fall from the rack body, said corrugated metal sheet member fabrication system comprising a material feeder adapted to feed a metal sheet material, a roller ramming unit adapted to receive said metal sheet material from said material feeder and to roller ram said metal sheet material into a corrugated form, a cutting unit adapted to cut said corrugated form into corrugated metal sheet members subject to a desired size, the finished product receiving rack comprising:

two guardrails arranged in parallel along the length of said rack body and together defining a horizontal plane, wherein the guardrails are configured to be selectively translated horizontally towards and away from each other so as to vary a horizontal gap therebetween;

two transmission shafts arranged in parallel along the length of said rack body;

two sets of steering gears arranged on said rack body at two opposite lateral sides along the length of said rack body corresponding to said rollers and respectively coupled to said transmission shafts;

two sets of guide screws respectively coupled to said steering gears and said guardrails and rotatable by said steering gears forwards/backwards to move said guardrails relative to each other so as to vary the horizontal gap between the guardrails; and two motors fixedly mounted on said rack at two sides and adapted to rotate said steering gears.

2. The finished product receiving rack as claimed in claim 1, further comprising a plurality of transfer tables transversely arranged below said rack body, and a plurality of lifters spaced from one another along the length of said rack body, said lifters each having a lifting platform controllable to move vertically between said rollers at said rack body and said transfer tables for collecting finished products from said rollers in a stack and carrying stacked finished products to said transfer tables.

3. The finished product receiving rack as claimed in claim 1, wherein said lifters each comprise an upper limit sensor and a lower limit sensor arranged at different elevations and adapted to control vertical movement of said lifting platforms between an upper limit elevation and a lower limit elevation.

4. The finished product receiving rack as claimed in claim 3, wherein a signal is generated when the lifting platform engages the lower limit sensor to automatically stop operation of the lifting platform and the cutting unit.

* * * * *